US009583058B2

(12) United States Patent
Wang et al.

(10) Patent No.: US 9,583,058 B2
(45) Date of Patent: Feb. 28, 2017

(54) DISPLAY DRIVING CIRCUIT FOR ELIMINATING DELAY ERRORS AMONG DISPLAY DRIVING SIGNALS, DRIVING METHOD THEREOF AND DISPLAY APPARATUS

(71) Applicant: BOE TECHNOLOGY GROUP CO., LTD., Beijing (CN)

(72) Inventors: Yanfeng Wang, Beijing (CN); Yan He, Beijing (CN); Yanan Jia, Beijing (CN); Guobing Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 96 days.

(21) Appl. No.: 14/417,337

(22) PCT Filed: May 28, 2014

(86) PCT No.: PCT/CN2014/078704

§ 371 (c)(1),
(2) Date: Jan. 26, 2015

(87) PCT Pub. No.: WO2015/062262

PCT Pub. Date: May 7, 2015

(65) Prior Publication Data

US 2015/0379949 A1 Dec. 31, 2015

(30) Foreign Application Priority Data

Oct. 30, 2013 (CN) ..... 2013 1 0526185

(51) Int. Cl.
*G09G 3/36* (2006.01)

(52) U.S. Cl.
CPC ..... *G09G 3/3648* (2013.01); *G09G 3/3611* (2013.01); *G09G 3/3674* (2013.01);
(Continued)

(58) Field of Classification Search
CPC .. G09G 3/3233–3/3291; G09G 3/3659; G09G 3/3685–3/3696;
(Continued)

(56) References Cited

U.S. PATENT DOCUMENTS 6,067,061 A * 5/2000 Friedman ..... G09G 3/22 345/205
6,288,699 B1 * 9/2001 Kubota ..... G09G 3/3648 345/213
(Continued)

FOREIGN PATENT DOCUMENTS

CN 1497508 A 5/2004
CN 1536401 A 10/2004
(Continued)

OTHER PUBLICATIONS

International Search Report and Written Opinion both dated Sep. 3, 2014; PCT/CN2014/078704.
(Continued)

*Primary Examiner* — Sanghyuk Park
(74) *Attorney, Agent, or Firm* — Ladas & Parry LLP

(57) ABSTRACT

Provided are a display driving circuit, a driving method thereof and a display apparatus. The display driving circuit comprises a timing sequence control unit (20) and at least one signal driving unit (30) connected to the timing sequence control unit (20). The timing sequence control unit (20) comprises a receiving module (201), a processing module (202) and a sending module (203). The receiving module (201) receives feedback signals (FB) outputted from respective signal driving units (30) to the timing sequence control unit (20); the processing module (202) obtains a maximum delay time after comparing signal delay time of the signal driving units (30) according to the feedback signals (FB); the sending module (203) sends a second clock signal (CLK2) to respective signal driving units (30) accord-
(Continued)

ing to the maximum delay time such that respective signal driving units (30) receive the second clock signal (CLK2) simultaneously. Therefore, delay errors of the display driving signals can be eliminated, and distortion of the display image can be avoided.

20 Claims, 5 Drawing Sheets

(52) U.S. Cl.
CPC ..... *G09G 3/3685* (2013.01); *G09G 3/3696* (2013.01); *G09G 2300/0426* (2013.01); *G09G 2310/08* (2013.01); *G09G 2370/08* (2013.01)

(58) Field of Classification Search
CPC ..... G09G 2310/0262–2310/0297; G09G 2310/08; G09G 5/18
See application file for complete search history.

(56) References Cited

U.S. PATENT DOCUMENTS

| | | | | |
|---|---|---|---|---|
| 7,116,306 | B2 | 10/2006 | Lin | |
| 2004/0061675 | A1 | 4/2004 | Hirakawa et al. | |
| 2004/0201563 | A1 | 10/2004 | Kobayashi | |
| 2004/0227716 | A1* | 11/2004 | Lin | G09G 3/3648 345/99 |
| 2006/0022933 | A1* | 2/2006 | Endo | G09G 3/3614 345/98 |
| 2006/0214928 | A1* | 9/2006 | Koyama | G09G 3/3648 345/204 |
| 2007/0236486 | A1 | 10/2007 | Ku | |
| 2009/0146713 | A1 | 6/2009 | Senda et al. | |
| 2010/0156879 | A1 | 6/2010 | Hong et al. | |
| 2010/0156885 | A1* | 6/2010 | Cho | G09G 3/006 345/214 |
| 2010/0225637 | A1* | 9/2010 | Jeon | G09G 3/20 345/213 |
| 2012/0056857 | A1* | 3/2012 | Li | G09G 3/20 345/204 |
| 2012/0242628 | A1* | 9/2012 | Yuan | G09G 3/20 345/204 |
| 2013/0021306 | A1* | 1/2013 | Kuo | G09G 3/20 345/204 |

FOREIGN PATENT DOCUMENTS

| | | | |
|---|---|---|---|
| CN | 101453212 | A | 6/2009 |
| CN | 103065595 | A | 4/2013 |
| CN | 103198803 | A | 7/2013 |
| CN | 103531169 | A | 1/2014 |
| TW | I228698 | B | 3/2005 |

OTHER PUBLICATIONS

Written Opinion of the International Searching Authority dated Aug. 28, 2014; PCT/CN2014/078704.

International Search Report dated Mar. 9, 2014; PCT/CN2014/078704.

First Chinese Office Action dated Mar. 10, 2015; Appln. No. 201310526185.5.

* cited by examiner

DISPLAY DRIVING CIRCUIT FOR ELIMINATING DELAY ERRORS AMONG DISPLAY DRIVING SIGNALS, DRIVING METHOD THEREOF AND DISPLAY APPARATUS

TECHNICAL FIELD

The present disclosure relates to a display driving circuit, a driving method thereof and a display apparatus.

BACKGROUND

As a flat panel display apparatus, a Thin Film Transistor Liquid Crystal Display (TFT-LCD) has advantages of small volume, low power consumption, radiation free, relative low manufacture cost and so on, and has been increasingly applied in the field of high performance display.

FIG. 1 shows a configuration of a liquid crystal display including a display panel 100 and driving units. The driving units further comprise a data driving circuit 110, a gate driving circuit 120 and a timing sequence controller 130. The timing sequence controller 130 inputs a clock signal to the data driving circuit 110, and the data driving circuit 110 converts the clock signal and display data into analog signals (D1, D2 . . . Dn) and then inputs the same to data lines of the display panel 100. The gate driving circuit 120 can convert the clock signal inputted from the timing sequence controller 130 into voltage signals (G1, G2 . . . Gm) for controlling pixels in the display panel 100 to be turned on or off, and apply the same to gate lines of the display panel 100 row by row. During the displaying operation of the liquid crystal display, on the basis of the clock signal, the gate lines input control signals to turn on the pixels row by row, and the display panel 100 operates to display according to the data signals on the data lines.

At present, the display panel and the driving units can be connected through interface technology. For example, the interface technology comprises Mini-low Voltage Differential Signaling (Mini-LVDS) interface technology and Point to Point (P2P) interface technology.

With rapid development of display technology, the size of a display panel is larger and larger in order to further improve display effect of a display. However, for the driving units on the display panel, a following problem arises. As illustrated in FIG. 2, taking the Mini-LVDS interface technology as an example, there is a large difference among distances from respective source driver ICs (S-IC for short) on the driving units to the timing sequence controller (TCON) 10, the S-IC close to the TCON 10 will receive the clock signal CLK outputted from the TCON 10 firstly, therefore the clock signal CLK outputted from the TCON 10 arrives at respective S-ICs at different time. For example, as illustrated in FIG. 2, the distance from the S-IC2 to the TCON 10 is smaller than that from the S-IC1 to the TCON 10, and thus the clock signal CLK1 arriving at the S-IC1 has a delay relative to the clock signal CLK2 arriving at the S-IC2 during a T1 phase, as illustrated in FIG. 3, such that a delay error occurs between the data signal D2 outputted from the S-IC2 and the data signal D1 outputted from the S-IC1. Similarly, the clock signal CLKn arriving at the S-ICn has a delay relative to the clock signal CLKn-1 arriving at the S-ICn-1 during a T2 phase, such that a delay error occurs between the data signal Dn outputted from the S-ICn and the data signal Dn-1 outputted from the S-ICn-1. Therefore, the delays between the clock signals CLKs received at the respective S-ICs are different since the distances from respective S-ICs to the TCON 10 are different, such that delay errors will appear among the data signals outputted from the S-ICs and a defective display phenomenon, such as distortion, will occur in the displayed image, and thus display effect of the display will be significantly affected and quality of the display product will be reduced.

SUMMARY

There are provided a display driving circuit, a driving method thereof and a display apparatus in embodiments of the present disclosure capable of removing delay errors among display driving signals and avoiding the occur of distortion phenomenon of a display image.

Following technical solutions are adopted in the embodiments of the present disclosure.

In accordance with one aspect of the present disclosure, there is provided a display driving circuit comprising a timing sequence control unit and at least one signal driving unit connected to the timing sequence control unit, wherein the timing sequence control unit is configured to send first clock signals to respective signal driving units and comprises: a receiving module connected to respective signal driving units and configured to receive feedback signals outputted from respective signal driving units to the timing sequence control unit after the signal driving units receive the first clock signals; a processing module configured to obtain signal delay time of respective signal driving units according to the feedback signals and obtain a maximum delay time according to the signal delay time of the respective signal driving units; a sending module configured to send a second clock signal to respective signal driving units according to the maximum delay time such that the respective signal driving units receive the second clock signal simultaneously.

In accordance with another aspect of the embodiments of the present disclosure, there is provided a display apparatus comprising the above-described display driving circuit.

In accordance with another aspect of the embodiments of the present disclosure, there is provided a driving method for a display driving circuit comprising a timing sequence control unit and at least one signal driving unit connected to the timing sequence control unit, wherein the method comprises: sending first clock signals, by the timing sequence control unit, to respective signal driving units; receiving, by the timing sequence control unit, feedback signals outputted from respective signal driving units to the timing sequence control unit after the signal driving units receive the first clock signals; obtaining, by the timing sequence control unit, a signal delay time of respective signal driving units according to the feedback signals and obtaining a maximum delay time according to the signal delay time of the respective signal driving units; and sending, by the timing sequence control unit, a second clock signal to respective signal driving units according to the maximum delay time such that the respective signal driving units receive the second clock signal simultaneously.

In the display driving circuit, the driving method thereof and the display apparatus provided in the embodiments of the present disclosure, the display driving circuit comprises a timing sequence control unit and at least one signal driving unit connected to the timing sequence control unit, wherein the timing sequence control unit comprises a receiving module, a processing module and a sending module. Under this configuration, the receiving module receives feedback signals outputted from the respective signal driving units to the timing sequence control unit; the processing module obtains a maximum delay time after comparing signal delay time of the respective signal driving units according to the feedback signals; the sending module finally sends a second clock signal to respective signal driving units according to the maximum delay time such that the respective signal driving unit receive the second clock signal simultaneously. Therefore, the display driving signals outputted from the respective signal driving units can be synchronized, such that the defective display phenomenon such as distortion in a display image can be avoided, display effect can be improved, and quality of the display product can be improved.

BRIEF DESCRIPTION OF THE DRAWINGS

In order to more clearly describe the technical solutions of the embodiments of the present disclosure or the prior art, drawings necessary for describing the embodiments of the present disclosure or the prior art are simply introduced as follows. Obviously, the accompanying drawings described as below are only for illustrating some of the embodiments of the present disclosure, and those skilled in the art can obtain other accompanying drawings from the drawings described without paying any inventive labor.

DETAILED DESCRIPTION

Hereinafter, the technical solutions in the embodiments of the present disclosure will be described clearly and thoroughly with reference to the accompanying drawings of the embodiments of the present disclosure. Obviously, the embodiments as described are only some of the embodiments of the present disclosure, and are not all of the embodiments of the present disclosure. All other embodiments obtained by those skilled in the art based on the embodiments in the present disclosure without paying any inventive labor should fall into the protection scope of the present disclosure.

Figure 1:
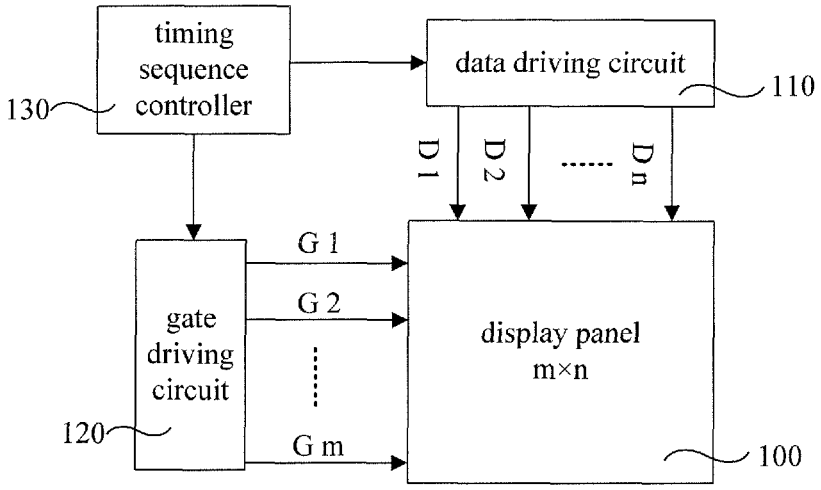
FIG. 1 is a schematic structure diagram of a liquid crystal display.
Figure 2:
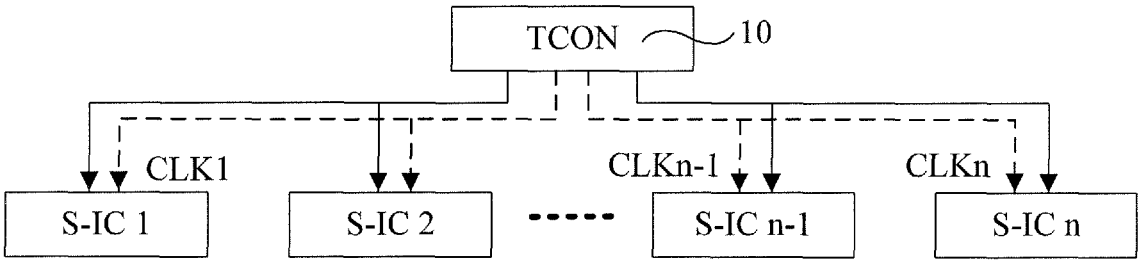
FIG. 2 is a schematic structure diagram of an interface.
Figure 3:
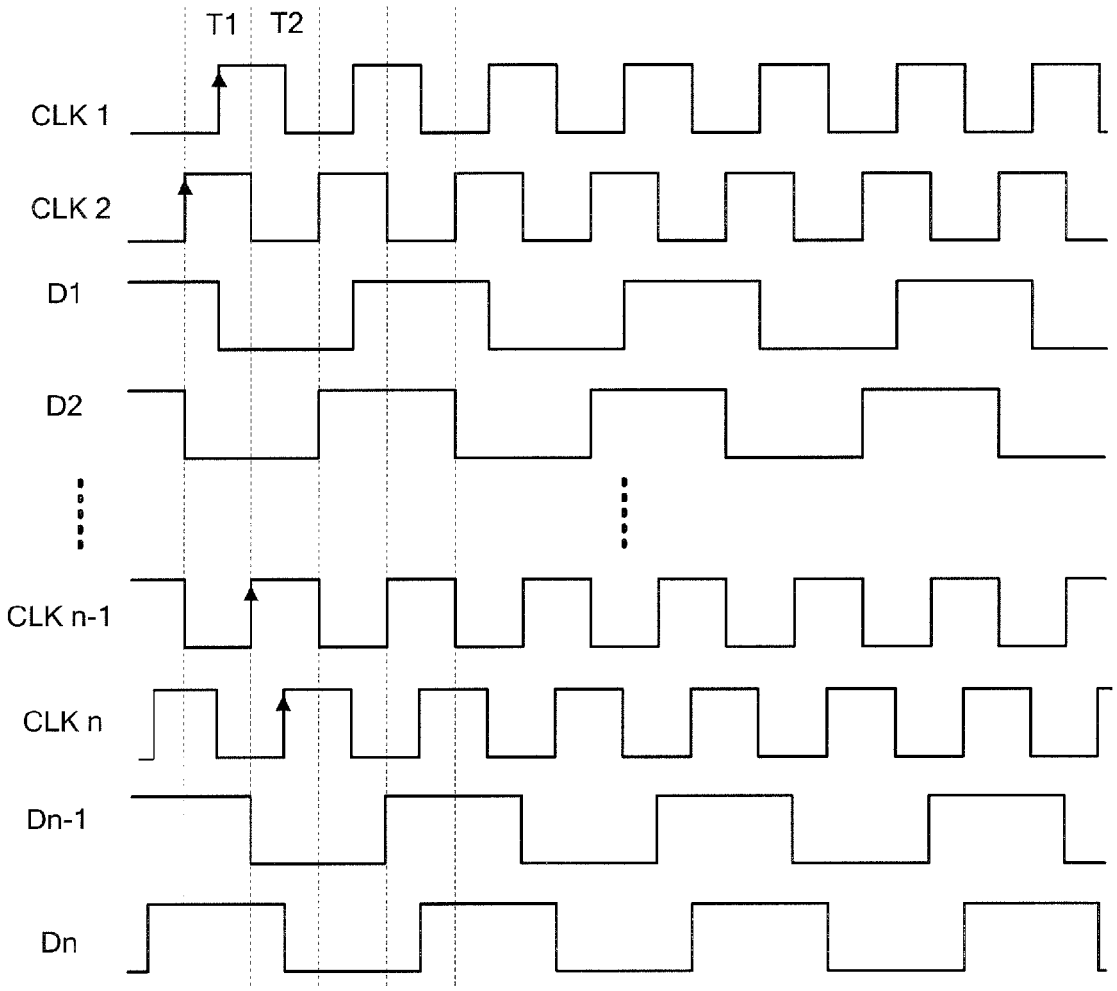
FIG. 3 is a timing sequence control diagram of a display driving circuit.
Figure 4:
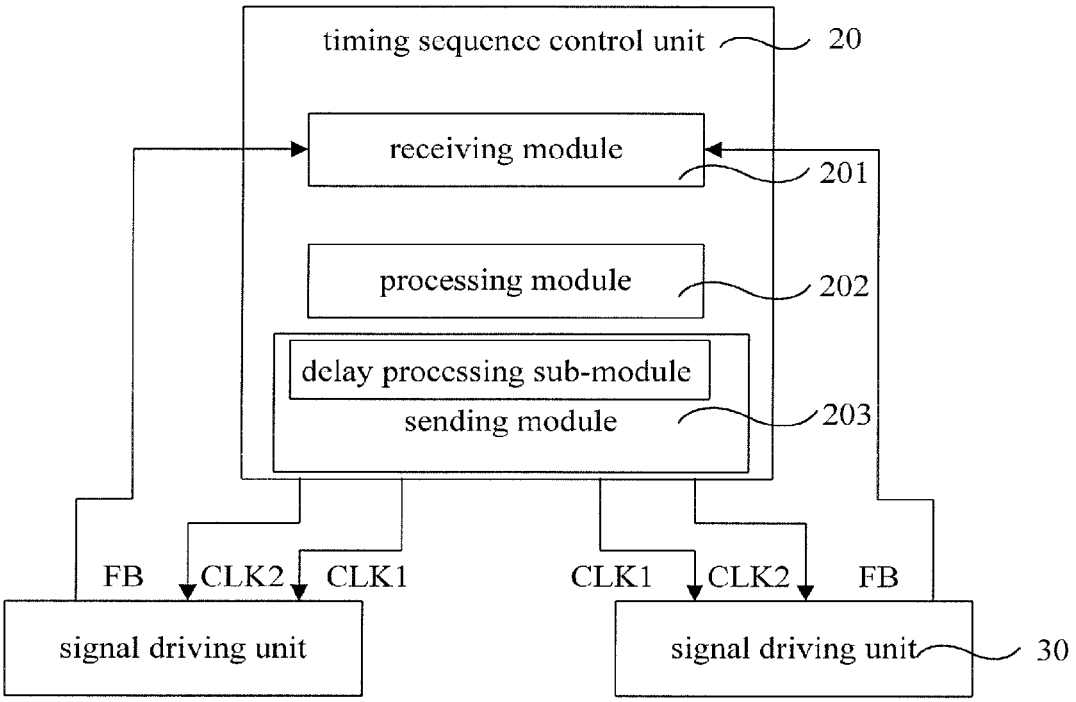
FIG. 4 is a schematic structure diagram of a display driving circuit provided in the embodiments of the present disclosure.

As illustrated in FIG. 4, a display driving circuit provided in the embodiments of the present disclosure comprises a timing sequence control unit 20 and at least one signal driving unit 30 connected to the timing sequence control unit 20. The timing sequence control unit 20 can comprise a receiving module 201 connected to respective signal driving units 30 and configured to receive feedback signals FB outputted from respective signal driving units 30 to the timing sequence control unit 20 after the respective signal driving units 30 receive first clock signals CLK1; a processing module 202 configured to obtain a signal delay time T of respective signal driving units 30 according to the feedback signals FB and obtain a maximum delay time Tmax according to the signal delay time T of respective signal driving units 30; a sending module 203 configured to send a second clock signal CLK2 to respective signal driving units 30 according to the maximum delay time Tmax such that respective signal driving units 30 receive the second clock signal CLK2 simultaneously.

It should be noted that the processing module 202 can obtain the maximum delay time Tmax according to the signal delay time T of respective signal driving units 30 in the following manners, for example:

The processing module 202 can compare the signal delay time T of respective signal driving units 30 and a preset reference time Tn sequentially so as to obtain the maximum delay time Tmax. The preset reference time Tn may be the time during which the timing sequence control unit 20 sends the first clock signals CLK1 to all of the signal driving units 30.

Alternatively, the processing module 202 can compare the signal delay time T of any two of the signal driving units 30 to obtain a longer delay time, compare the longer delay time and the signal delay time T of another signal driving unit 30 not compared yet, and repeat the above steps until the signal delay time T of respective signal driving units 30 has been compared, so as to obtain the maximum delay time Tmax.

Figure 5:
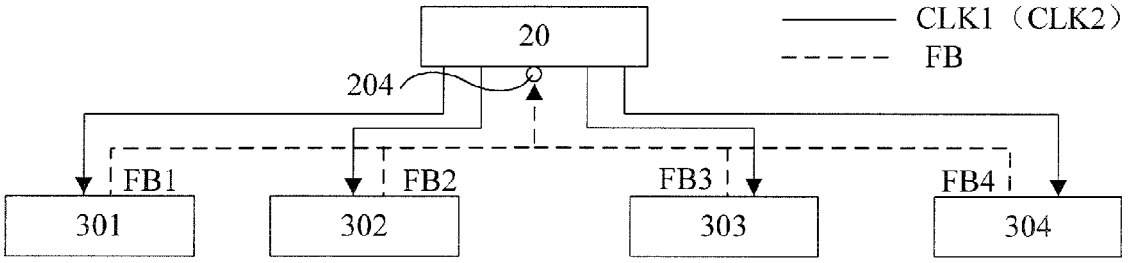
FIG. 5 is a schematic structure diagram of another display driving circuit provided in the embodiments of the present disclosure.

As illustrated in FIG. 5, description will be given by taking P2P interface technology as an example. The timing sequence control unit 20 is connected to a first signal driving unit 301, a second signal driving unit 302, a third signal driving unit 303 and a fourth signal driving unit 304. The distances from the second signal driving unit 302, the third signal driving unit 303, the first signal driving unit 301 and the fourth signal driving unit 304 to the timing sequence control unit 2 are increased in sequence. Therefore, the delay time for the respective signal driving units to receive the signal output from the timing sequence control unit 20, that is, the delay time T2 of the second signal driving unit 302, the delay time T3 of the third signal driving unit 303, the delay time T1 of the first signal driving unit 301, and the delay time T4 of the fourth signal driving unit 304, are increased in sequence.

The processing module 202 in the timing sequence control unit 20 can firstly compare the signal delay time T1 of the first signal driving unit 301 and the signal delay time T2 of the second signal driving unit 302 to determine that the signal delay time T1 of the first signal driving unit 301 is longer, then compare the signal delay time T1 of the first signal driving unit 301 and the signal delay time T3 of the third signal driving unit 303 to determine that the signal delay time T1 of the first signal driving unit 301 is longer, and lastly compare the signal delay time T1 of the first signal driving unit 301 and the signal delay time T4 of the fourth signal driving unit 304 to determine that the maximum delay time Tmax is the signal delay time T4 of the fourth signal driving unit 304.

It should be noted that the maximum delay time Tmax may also be a preset numeric value and longer than the signal delay time T of all the signal driving units 30. Of course, only an exemplary illustration on the scheme for obtaining the maximum delay time Tmax is given as above, and other schemes for obtaining the maximum delay time Tmax are not described herein but should fall in the protection scope of the present disclosure.

The display driving circuit provided in the embodiments of the present disclosure comprises a timing sequence control unit and at least one signal driving unit connected to the timing sequence control unit. The timing sequence control unit comprises a receiving module, a processing module and a sending module. Under this configuration, the receiving module receives feedback signals outputted from respective signal driving units to the timing sequence control unit; the processing module then obtains a maximum delay time after comparing the signal delay time of the signal driving units according to the feedback signals; the sending module finally sends a second clock signal to respective signal driving units according to the maximum delay time such that respective signal driving units receives the second clock signal simultaneously. Therefore, the display driving signals outputted from the respective signal driving units can be synchronized, such that the defective display phenomenon such as distortion in a display image can be avoided, display effect can be improved, and quality of the display product can be improved.

Optionally, after respective signal driving units 30 receive the first clock signals CLK1, the receiving module 201 receives the first clock signals CLK1 outputted from the signal driving unit 30 to the timing sequence control unit 20. That is, after receiving the first clock signal CLK1, the signal driving unit 30 feeds the first clock signal CLK1 as a feedback signal FB back to the receiving module 201. Under this configuration, it is unnecessary for the signal driving unit 30 to output to the timing sequence control unit 20 a signal indicating the delay time information of the signal driving unit 30 receiving the first clock signal CLK1. Therefore, the configuration and the control method of the display driving circuit can be simplified.

Alternatively, after respective signal driving units 30 receive the first clock signals CLK1, the receiving module 201 is configured to receive and record the timing at which the respective signal driving units 30 receive the first clock signals CLK1. That is, after receiving the first clock signal CLK1, the signal driving unit 30 records the timing at which the signal driving unit 30 receives the first clock signal CLK1 and feeds the same as a feedback signal FB back to the receiving module 201. Under this configuration, the timing sequence control unit 20 can obtain the timing at which the first clock signal CLK1 is received by the signal driving unit 30, and then the processing unit 202 can compare and analyze the timing at which respective signal driving units 30 receive the first clock signals CLK1 so as to obtain the maximum delay time Tmax.

Optionally, the receiving module 201 may comprise a signal input terminal connected to respective signal driving units 30. As illustrated in FIG. 5, the signal input terminal may be a feedback pin 204 on a timing sequence control chip of the timing sequence control unit 20. In this figure, the feedback signal FB of the first signal driving unit 301, the feedback signal FB of the second signal driving unit 302, the feedback signal FB of the third signal driving unit 303 and the feedback signal FB of the fourth signal driving unit 304 are fed back to the timing sequence control unit 20 via the same feedback pin 204. Under such a configuration, the number of the feedback pins can be reduced, and thus the configuration of the display driving circuit can be simplified and the manufacture cost can be reduced.

For example, when the receiving module 201 comprises one signal input terminal as illustrated in FIG. 5, the feedback signal FB of the first signal driving unit 301, the feedback signal FB of the second signal driving unit 302, the feedback signal FB of the third signal driving unit 303 and the feedback signal FB of the fourth signal driving unit 304 are fed back to the timing sequence control unit 20 via one feedback pin 204. The receiving module 201 can receive the feedback signals FB outputted from respective signal driving units 30 to the timing sequence control unit 20 in a time division manner. For example, the receiving module 201 receives the feedback signal FB1 outputted from the first signal driving unit 301 to the timing sequence control unit 20 through the feedback pin 204 at a first timing, receives the feedback signal FB2 outputted from the second signal driving unit 302 to the timing sequence control unit 20 through the feedback pin 204 at a second timing, receives the feedback signal FB3 outputted from the third signal driving unit 303 to the timing sequence control unit 20 through the feedback pin 204 at a third timing, and receives the feedback signal FB4 outputted from the fourth signal driving unit 304 to the timing sequence control unit 20 through the feedback pin 204 at a fourth timing.

Figure 6:
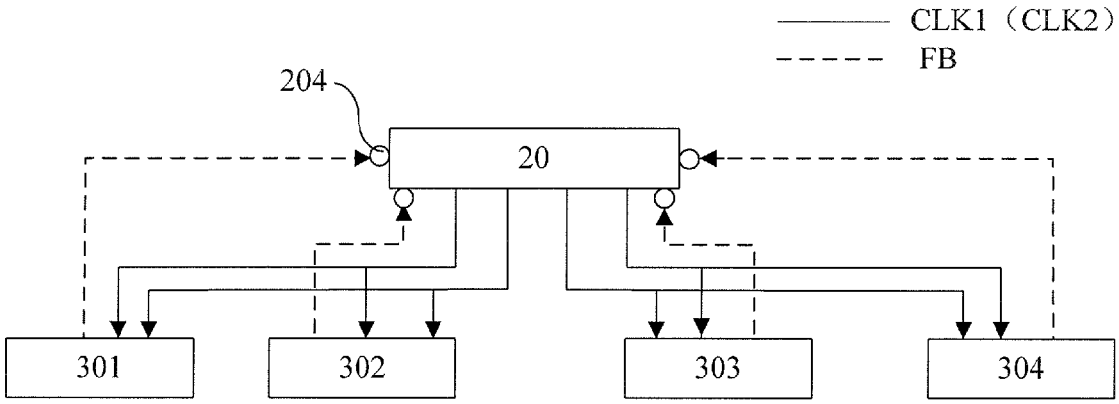
FIG. 6 is a schematic structure diagram of another display driving circuit provided in the embodiments of the present disclosure.

Alternatively, the receiving module 201 may comprise a plurality of signal input terminals each is connected to a corresponding signal driving unit. As illustrated in FIG. 6, description will be given by taking the Mini-LVDS interface technology as an example. The signal input terminals may be feedback pins 204 on a timing sequence control chip of the timing sequence control unit 20. Each signal driving units 30 corresponds to one feedback pin 204, and as illustrated in this figure, the feedback signal FB of the first signal driving unit 301, the feedback signal FB of the second signal driving unit 302, the feedback signal FB of the third signal driving unit 303 and the feedback signal FB of the fourth signal driving unit 304 are fed back to the timing sequence control unit 20 through four feedback pins 204, respectively. Under such a configuration, the receiving module 201 can receive the feedback signals FB outputted from respective signal driving units 30 to the timing sequence control unit 20 through corresponding feedback pins 204 respectively.

Furthermore, the sending module 203 comprises a delay processing sub-module configured to delay the second clock signal CLK2 to be sent to the signal driving units to the maximum delay time Tmax and then send the same, when the signal delay time T of the signal driving unit 30 is smaller than the maximum delay time Tmax, such that respective signal driving units 30 can receive the second clock signal CLK2 simultaneously.

For example, as illustrated in FIG. 5, the distances from respective signal driving units, that is, the distances from the second signal driving unit 302, the third signal driving unit 303, the first signal driving unit 301 and the fourth signal driving unit 304 to the timing sequence control unit 20, are increased in sequence. The timing sequence control unit 20 sends the first clock signals CLK1 to the respective signal driving units 30 during the reference time Tn. Therefore, with respect to the reference time Tn, the delay time for the respective signal driving units to receive the first clock signals CLK1, that is, the delay time T2 of the second signal driving unit 302, the delay time T3 of the third signal driving unit 303, the delay time T1 of the first signal driving unit 301, and the delay time T4 of the fourth signal driving unit 304, are increased in sequence. Therefore, the maximum delay time Tmax is the delay time T4 of the fourth signal driving unit 304. At this time, the delay time T2 of the second signal driving unit 302, the delay time T3 of the third signal driving unit 303 and the delay time T1 of the first signal driving unit 301 are all smaller than the maximum delay time Tmax. Therefore, the sending module 203 delays the second clock signal CLK2 to be sent to the second signal driving unit 302 to equal to the maximum delay time Tmax and then sends the same, that is, the sending module 203 sends the second clock signal CLK2 to the second signal driving unit 302 after a delay time reference T4-T2. Similarly, the sending module 203 sends the second clock signal CLK2 to the third signal driving unit 303 after a delay time reference T4-T3, and the sending module 203 sends the second clock signal CLK2 to the first signal driving unit 301 after a delay time reference T4-T1. Further, the sending module 203 sends the second clock signal CLK2 to the fourth signal driving unit 304 directly without any delay. Under such a configuration, the first signal driving unit 301, the second signal driving unit 302, the third signal driving unit 303 and the fourth signal driving unit 304 can receive the second clock signal CLK2 sent from the sending module 203 simultaneously, such that the display driving signals outputted from the respective signal driving units can be synchronized, and thereby the defective display phenomenon such as distortion in a display image can be avoided, display effect can be improved, and quality of the display product can be improved.

Optionally, the signal driving unit 30 may comprise a source driver (S-IC for short) connected to data lines and configured to drive the data lines; and/or a gate driver connected to gate lines and configured to drive the gate lines.

It should be noted that a liquid crystal display can generally comprise a display panel and a display driving circuit connected to the display panel through interface technology. The display panel comprises an array substrate and a color filter substrate, and the liquid crystal is filled between the array substrate and the color filter substrate. The array substrate comprises gate lines and data lines intersected in a horizontal direction and a vertical direction and a plurality of pixel units arranged in a matrix and divided by the intersected gate lines and data lines. During display operation of the liquid crystal display, on the basis of the clock signal outputted from the timing sequence control unit 20, the gate driver IC drives the gate lines to input control signals so as to turn on the pixels row by row, and the source driver IC drives the data lines to input data signals so as to make the display panel perform the display.

The signal driving unit 30 provided in the embodiments of the present disclosure may include a source driver and/or a gate driver. Under such a configuration, the source driver and the gate driver can receive the clock signal outputted from the timing sequence control unit 20 simultaneously, such that the data signals outputted to the data lines by the source driver and the control signals outputted to the gate lines by the gate driver can be synchronized, such that delay errors among the respective display driving signals can be eliminated, and thus the defective display phenomenon such as distortion in a display image can be avoided, display effect can be improved, and quality of the display product can be improved.

Figure 7:
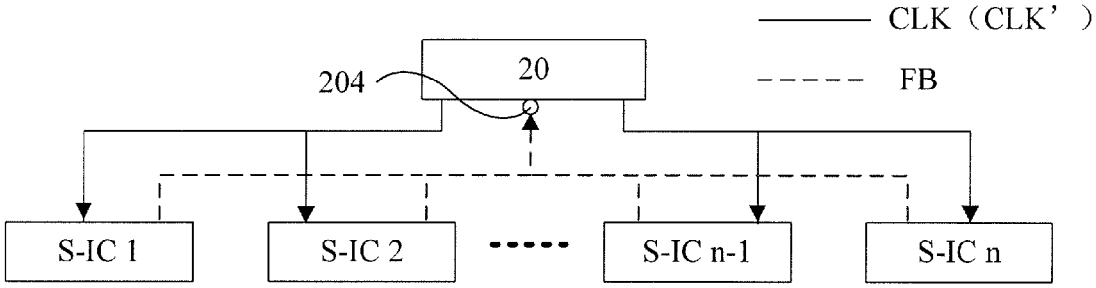
FIG. 7 is a schematic structure diagram of still another display driving circuit provided in the embodiments of the present disclosure.

For example, as illustrated in FIG. 7, taking the Mini-LVDS interface as an example, in case that there is only one feedback pin 204, the receiving module 201 of the timing sequence control unit 20 can receive the feedback signals FB of the respective source drivers S-IC1 . . . S-ICn in a time division manner. Therefore, the number of the physical pins can be reduced and the structure of the circuit can be simplified while the receipt of a plurality of feedback signals can be achieved. Herein, only exemplary illustration is given by taking the circuit configuration of the source drivers as an example, and the circuit configuration of the gate drivers are not described repeatedly herein but should fall in the protection scope of the present disclosure.

In the embodiments of the present disclosure, there is provided a display apparatus comprising any one of the above-described display driving circuits. The display apparatus may be any product or component having display function including display panel, electronic paper, OLED panel, liquid crystal television, liquid crystal display, digital photo frame, cell phone, tablet computer and so on. The display apparatus has the same advantageous effects as the display driving circuit provided in the above described embodiments of the present disclosure and repeated description is omitted herein since the display driving circuit has been described in detail in the above-described embodiments of the present disclosure.

The display apparatus provided in the embodiments of the present disclosure comprises a display driving circuit comprising a timing sequence control unit and at least one signal driving unit connected to the timing sequence control unit. The timing sequence control unit comprises a receiving module, a processing module and a sending module. Under this configuration, the receiving module receives feedback signals outputted from respective signal driving units to the timing sequence control unit; the processing module then obtains a maximum delay time after comparing the signal delay time of the respective signal driving units according to the feedback signals; the sending module finally sends a second clock signal to the respective signal driving units according to the maximum delay time such that the respective signal driving units receives the second clock signal simultaneously. Therefore, the display driving signals outputted from the respective signal driving units can be synchronized, such that the defective display phenomenon such as distortion in a display image can be avoided, display effect can be improved, and quality of the display product can be improved.

Figure 8:
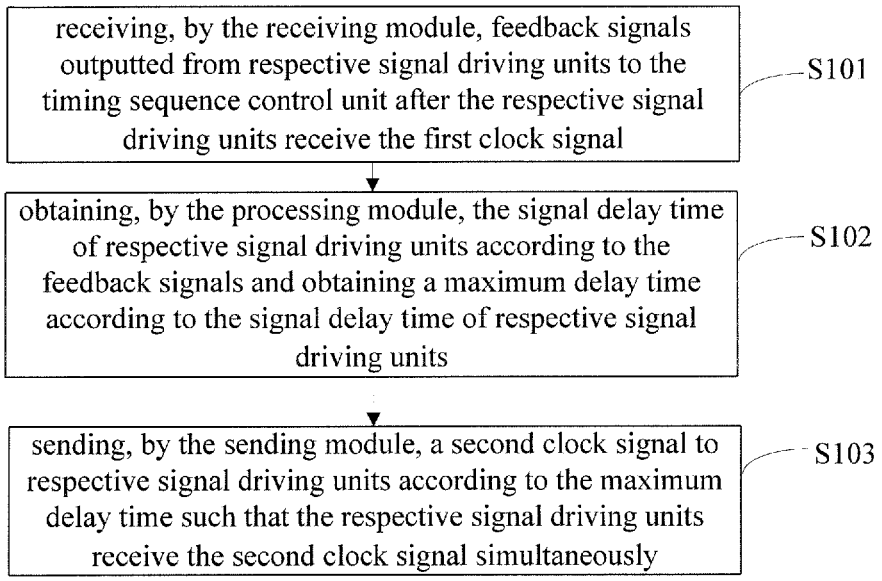
FIG. 8 is a flowchart of a driving method for the display driving circuit provided in the embodiments of the present disclosure.

In the embodiments of the present disclosure, there is provided a driving method for a display driving circuit comprising a timing sequence control unit 20 and at least one signal driving unit 30 connected to the timing sequence control unit 20. As illustrated in FIG. 8, the method comprises the following steps.

At S101, a receiving module 201 receives feedback signals FB outputted from respective signal driving units 30 to the timing sequence control unit 20 after the respective signal driving units 30 receive first clock signals CLK1.

At S102, a processing module 202 obtains a signal delay time T of the respective signal driving units 30 according to the feedback signals FB and obtains a maximum delay time Tmax according to the signal delay time T of the respective signal driving units 30.

At S103, a sending module 203 sends a second clock signal CLK2 to respective signal driving units 30 according to the maximum delay time Tmax such that respective signal driving units 30 receive the second clock signal CLK2 simultaneously.

It should be noted that the processing module 202 can obtain the maximum delay time Tmax according to the signal delay time T of respective signal driving units 30 in the following manners, for example.

The processing module 202 can compare the signal delay time T of respective signal driving units 30 and a preset reference time Tn sequentially so as to obtain the maximum delay time Tmax. The preset reference time Tn may be the time during which the timing sequence control unit 20 sends the first clock signals CLK1 to all the signal driving units 30.

Alternatively, the processing module 202 can compare the signal delay time T of any two of the signal driving units 30 to obtain a longer delay time, compare the longer delay time and the signal delay time T of another signal driving unit 30 not compared yet, and repeat the above steps until the signal delay time T of respective signal driving units 30 has been compared, so as to obtain the maximum delay time Tmax.

For example, as illustrated in FIG. 5, description will be given by taking P2P interface technology as an example. The timing sequence control unit 20 is connected to a first signal driving unit 301, a second signal driving unit 302, a third signal driving unit 303 and a fourth signal driving unit 304. The distances from the respective signal driving units, i.e., the second signal driving unit 302, the third signal driving unit 303, the first signal driving unit 301 and the fourth signal driving unit 304, to the timing sequence control unit 20, are increased in sequence. Therefore, the delay time for the respective signal driving units to receive the signal output from the timing sequence control unit 20, that is, the delay time T2 of the second signal driving unit 302, the delay time T3 of the third signal driving unit 303, the delay time T1 of the first signal driving unit 301, and the delay time T4 of the fourth signal driving unit 304, are increased in sequence.

The processing module 202 in the timing sequence control unit 20 can firstly compare the signal delay time T1 of the first signal driving unit 301 and the signal delay time T2 of the second signal driving unit 302 to determine that the signal delay time T1 of the first signal driving unit 301 is longer, then compare the signal delay time T1 of the first signal driving unit 301 and the signal delay time T3 of the third signal driving unit 303 to determine that the signal delay time T1 of the first signal driving unit 301 is longer, and lastly compare the signal delay time T1 of the first signal driving unit 301 and the signal delay time T4 of the fourth signal driving unit 304 to determine that the maximum delay time Tmax is the signal delay time T4 of the fourth signal driving unit 304.

It should be noted that the maximum delay time Tmax may also be a preset numeric value and longer than the signal delay time T of all the signal driving units 30. Of course, only exemplary illustration of the scheme for obtaining the maximum delay time Tmax is given as above, and other schemes for obtaining the maximum delay time Tmax are not described herein but should fall in the protection scope of the present disclosure.

In the driving method for the display driving circuit provided in the embodiments of the present disclosure, the display driving circuit comprises a timing sequence control unit and at least one signal driving unit connected to the timing sequence control unit. The timing sequence control unit comprises a receiving module, a processing module and a sending module. Under this configuration, the receiving module receives feedback signals outputted from respective signal driving units to the timing sequence control unit; the processing module then obtains a maximum delay time after comparing signal delay time of the signal driving units according to the feedback signals; the sending module finally sends a second clock signal to respective signal driving units according to the maximum delay time such that respective signal driving units receive the second clock signal simultaneously. Therefore, the display driving signals outputted from the respective signal driving units can be synchronized, such that the defective display phenomenon such as distortion in a display image can be avoided, display effect can be improved, and quality of the display product can be improved.

Optionally, after respective signal driving units 30 receive the first clock signals CLK1, the first clock signal CLK1 inputted to the signal driving unit 30 by the timing sequence control unit 20 is used as a feedback signal FB. That is, after receiving the first clock signal CLK1, the signal driving unit 30 feeds the first clock signal CLK1 as a feedback signal FB back to the receiving module 201. Under this configuration, it is unnecessary for the signal driving unit 30 to output a signal for feeding the delay time information indicating that the signal driving unit 30 receives the first clock signal CLK1 back to the timing sequence control unit 20. Therefore, the configuration and the control method of the display driving circuit can be simplified.

Alternatively, after respective signal driving units 30 receive the first clock signals CLK1, the receiving timings at which the respective signal driving units 30 receive the first clock signals CLK1 are used as a feedback signal FB. That is, after receiving the first clock signal CLK1, the signal driving unit 30 records the timing at which the signal driving unit 30 receives the first clock signal CLK1 and feeds the same as a feedback signal FB back to the receiving module 201. Under this configuration, the timing sequence control unit 20 can obtain the timings at which the first clock signals CLK1 is received by the signal driving units 30, and then the processing unit 202 can compare the timings at which respective signal driving units 30 receive the first clock signals CLK1 so as to obtain the maximum delay time Tmax.

Optionally, when the timing sequence control unit 20 is connected to respective signal driving units 30 through one signal input terminal, the respective signal driving units 30 can output the feedback signals FB to the timing sequence control unit 20 in a time division manner. As illustrated in FIG. 5, the signal input terminal may be a feedback pin 204 on a timing sequence control chip of the timing sequence control unit 20. In this figure, the feedback signal FB of the first signal driving unit 301, the feedback signal FB of the second signal driving unit 302, the feedback signal FB of the third signal driving unit 303 and the feedback signal FB of the fourth signal driving unit 304 are fed back to the timing sequence control unit 20 via one feedback pin 204. Under such a configuration, the number of the feedback pins can be reduced, and thus the configuration of the display driving circuit can be simplified and the manufacture cost can be reduced.

For example, the receiving module 201 can receive the feedback signals FB outputted from respective signal driving units 30 to the timing sequence control unit 20 in a time division manner. For example, the receiving module 201 receives the feedback signal FB1 outputted from the first signal driving unit 301 to the timing sequence control unit 20 through the feedback pin 204 at a first timing, receives the feedback signal FB2 outputted from the second signal driving unit 302 to the timing sequence control unit 20 through the feedback pin 204 at a second timing, receives the feedback signal FB3 outputted from the third signal driving unit 303 to the timing sequence control unit 20 through the feedback pin 204 at a third timing, and receives the feedback signal FB4 outputted from the fourth signal driving unit 304 to the timing sequence control unit 20 through the feedback pin 204 at a fourth timing.

Optionally, the step that the second clock signal CLK2 is sent to respective signal driving units 30 according to the maximum delay time Tmax may be implemented as follows.

A delay processing sub-module of the sending module 203 delays the second clock signal CLK2 to be sent to the signal driving units 30 to the maximum delay time Tmax and then send the same when the signal delay time T of the signal driving unit 30 is smaller than the maximum delay time Tmax, such that respective signal driving units 30 can receive the second clock signal CLK2 simultaneously.

For example, as illustrated in FIG. 5, the distances from the respective signal driving units, i.e., the second signal driving unit 302, the third signal driving unit 303, the first signal driving unit 301 and the fourth signal driving unit 304, to the timing sequence control unit 20 are increased in sequence. The timing sequence control unit 20 sends the first clock signals CLK1 to the respective signal driving units 30 during the reference time Tn. Therefore, with respect to the reference time Tn, the delay time for the individual signal driving unit to receive the first clock signal CLK1, that is, the delay time T2 of the second signal driving unit 302, the delay time T3 of the third signal driving unit 303, the delay time T1 of the first signal driving unit 301, and the delay time T4 of the fourth signal driving unit 304, are increased in sequence. Therefore, the maximum delay time Tmax is the delay time T4 of the fourth signal driving unit 304. At this time, the delay time T2 of the second signal driving unit 302, the delay time T3 of the third signal driving unit 303 and the delay time T1 of the first signal driving unit 301 are all smaller than the maximum delay time Tmax. Therefore, the sending module 203 delays the second clock signal CLK2 to be sent to the second signal driving unit 302 to the maximum delay time Tmax and then sends the same, that is, the sending module 203 sends the second clock signal CLK2 to the second signal driving unit 302 after a delay time reference T4-T2. Similarly, the sending module 203 sends the second clock signal CLK2 to the third signal driving unit 303 after a delay time reference T4-T3, and the sending module 203 sends the second clock signal CLK2 to the first signal driving unit 301 after a delay time reference T4-T1. Further, the sending module 203 sends the second clock signal CLK2 directly to the fourth signal driving unit 304 without any delay. Under such a configuration, the first signal driving unit 301, the second signal driving unit 302, the third signal driving unit 303 and the fourth signal driving unit 304 can receive the second clock signal CLK2 sent from the sending module 203 simultaneously, such that the display driving signals outputted from the respective signal driving units can be synchronized, and thereby the defective display phenomenon such as distortion in a display image can be avoided, display effect can be improved, and quality of the display product can be improved.

Those ordinary skilled in the art can clearly understand that all or part of procedures implementing the above method embodiments of the present disclosure can be implemented through program instructing related hardware. The program may be stored in a computer readable storage medium, and the steps in the above method embodiments of the present disclosure are performed when the program is executed. The computer readable storage medium may include various media capable of storing program codes, for example, a ROM/RAM, a magnetic disk, an optical disk, and so on.

The above descriptions are only for illustrating the embodiments of the present disclosure, and in no way limit the scope of the present disclosure. It will be obvious that those skilled in the art may easily conceive of variations or alternatives in the technical scope disclosure in the embodiments of the present disclosure, and such variations or alternatives are intended to be covered within the protection scope of the present disclosure. Therefore, the protection scope of the present disclosure should be defined according to the attached claims.

The present application claims the priority of a Chinese application with an application No. 201310526185.5, filed on Oct. 30, 2013, and the disclosure of which is entirely incorporated herein by reference.

What is claimed is:

1. A display driving circuit comprising a timing sequence control unit and at least one signal driving unit connected to the timing sequence control unit, wherein the timing sequence control unit is configured to send first clock signals to respective signal driving units and comprises:

a receiving module connected to the respective signal driving units and configured to receive feedback signals outputted from the respective signal driving units to the timing sequence control unit after the respective signal driving units receive the first clock signals respectively;

a processing module configured to obtain a signal delay time of the respective signal driving units according to the feedback signals and to obtain a maximum delay time according to the signal delay time of the respective signal driving units;

a sending module configured to send a second clock signal to the respective signal driving units according to the maximum delay time such that respective signal driving units receive the second clock signal simultaneously.

2. The display driving circuit of claim 1, wherein the receiving module is configured to receive the first clock signals outputted from the respective signal driving units as the feedback signals to the timing sequence control unit; or the receiving module is configured to receive and record timings at which the respective signal driving units receive the first clock signals.

3. The display driving circuit of claim 1, wherein the receiving module comprises:

a signal input terminal connected to the respective signal driving units; or a plurality of signal input terminals each connected to each of the respective signal driving unit.

4. The display driving circuit of claim 3, wherein in a case in which the receiving module comprises only one signal input terminal connected to the respective signal driving units, the receiving module is configured to receive the feedback signals outputted from the respective signal driving units to the timing sequence control unit in a time division manner.

5. The display driving circuit of claim 1, wherein the sending module comprises a delay processing sub-module configured to delay the second clock signal, to be sent to a signal driving unit whose signal delay time is smaller than the maximum delay time, to the maximum delay time and then to send the delayed second clock signal, such that the respective signal driving units receive the delayed second clock signal simultaneously.

6. The display driving circuit of claim 1, wherein each of the respective signal driving units comprises:

a source driver connected to data lines and configured to drive the data lines; and/or a gate driver connected to gate lines and configured to drive the gate lines.

7. The display driving circuit of claim 1, wherein the processing module is configured to compare the signal delay time of the respective signal driving units with a preset reference time sequentially so as to obtain the maximum delay time.

8. The display driving circuit of claim 1, wherein the processing module is configured to compare the signal delay time of the respective signal driving units with each other so as to obtain the maximum delay time.

9. A display apparatus comprising the display driving circuit of claim 1.

10. The display apparatus of claim 9, wherein the receiving module is configured to receive the first clock signals outputted from the respective signal driving units as the feedback signals to the timing sequence control unit; or the receiving module is configured to receive and record timings at which the respective signal driving units receive the first clock signals.

11. The display apparatus of claim 9, wherein the receiving module comprises:

a signal input terminal connected to the respective signal driving units; or a plurality of signal input terminals each connected to each of the respective signal driving units, respectively.

12. The display apparatus of claim 11, wherein in a case in which the receiving module comprises only one signal input terminal connected to the respective signal driving units, the receiving module is configured to receive the feedback signals outputted from the respective signal driving units to the timing sequence control unit in a time division manner.

13. The display apparatus of claim 9, wherein the sending module comprises a delay processing sub-module configured to delay the second clock signal, to be sent to a signal driving unit whose signal delay time is smaller than the maximum delay time, to the maximum delay time and then to send the delayed second clock signal, such that the respective signal driving units receive the delayed second clock signal simultaneously.

14. The display apparatus of claim 9, wherein each of the respective signal driving units comprises:

a source driver connected to data lines and configured to drive the data lines; and/or a gate driver connected to gate lines and configured to drive the gate lines.

15. A driving method for a display driving circuit comprising a timing sequence control unit and at least one signal driving unit connected to the timing sequence control unit, wherein the driving method comprises:

sending first clock signals, by the timing sequence control unit, to respective signal driving units;

receiving, by the timing sequence control unit, feedback signals outputted from the respective signal driving units to the timing sequence control unit after the respective signal driving units receive the first clock signals;

obtaining, by the timing sequence control unit, a signal delay time of the respective signal driving units according to the feedback signals and obtaining a maximum delay time according to the signal delay time of the respective signal driving units; and sending, by the timing sequence control unit, a second clock signal, to the respective signal driving units according to the maximum delay time such that the respective signal driving units receive the second clock signal simultaneously.

16. The driving method of claim 15, wherein after the respective signal driving units receive the first clock signals respectively, the respective signal driving units output the first clock signals as feedback signals to the timing sequence control unit; or the respective signal driving units record timings at which the respective signal driving units receive the first clock signals as the feedback signals.

17. The driving method of claim 15, wherein in a case in which the timing sequence control unit is connected to the respective signal driving units via a same signal input terminal, the respective signal driving units output the feedback signals to the timing sequence control unit in a time division manner.

18. The driving method of claim 15, wherein sending the second clock signal to the respective signal driving units according to the maximum delay time comprises:

delaying the second clock signal, to be sent to a signal driving unit whose signal delay time is smaller than the maximum delay time, to the maximum delay time and then sending the delayed second clock signal, such that the respective signal driving units receive the delayed second clock signal simultaneously.

19. The driving method of claim 15, wherein the timing sequence control unit compares the signal delay time of the respective signal driving units with a preset reference time sequentially so as to obtain the maximum delay time.

20. The driving method of claim 15, wherein the timing sequence control unit compares the signal delay time of the respective signal driving units with each other to obtain the maximum delay time.

* * * * *